US011920882B2

(12) United States Patent
Dechant et al.

(10) Patent No.: US 11,920,882 B2
(45) Date of Patent: Mar. 5, 2024

(54) TRIGGER ASSEMBLY FOR A FIREARM

(71) Applicant: GLOCK TECHNOLOGY GMBH, Ferlach (AT)

(72) Inventors: Friedrich Dechant, Hollabrunn (AT); Leopold Oppenauer, Ried im Innkreis (AT); Thomas Stern, Neubau (AT); Erich Zoch, Hollabrunn (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 18/007,035

(22) PCT Filed: May 27, 2022

(86) PCT No.: PCT/EP2022/064390
§ 371 (c)(1),
(2) Date: Jan. 26, 2023

(87) PCT Pub. No.: WO2022/253698
PCT Pub. Date: Dec. 8, 2022

(65) Prior Publication Data

US 2024/0011729 A1 Jan. 11, 2024

(30) Foreign Application Priority Data

Jun. 1, 2021 (EP) ..... 21177171

(51) Int. Cl.
*F41A 19/10* (2006.01)
*F41A 19/12* (2006.01)
*F41A 19/32* (2006.01)

(52) U.S. Cl.
CPC ..... *F41A 19/10* (2013.01); *F41A 19/12* (2013.01); *F41A 19/32* (2013.01)

(58) Field of Classification Search
CPC ..... F41A 17/64; F41A 19/10; F41A 19/12; F41A 19/16; F41A 19/31; F41A 19/32; F41A 19/34
USPC ..... 42/69.01
See application file for complete search history.

(56) References Cited

U.S. PATENT DOCUMENTS 5,386,659 A 2/1995 Vaid
5,906,066 A * 5/1999 Felk ..... F41A 11/02 42/69.02
7,194,833 B1 3/2007 Curry
8,925,232 B2 1/2015 da Silveira
(Continued)

FOREIGN PATENT DOCUMENTS

DE 102005031927 B3 11/2006
DE 102013022082 B3 10/2014
(Continued)

*Primary Examiner* — Joshua E Freeman
*Assistant Examiner* — Benjamin S Gomberg
(74) *Attorney, Agent, or Firm* — Raven Patents, LLC; Anton E. Skaugset

(57) ABSTRACT

Trigger assemblies for firearms, such as pistols, that include a striker assembly with a spring-loaded firing pin and downwardly-protruding firing pin flag for interaction with the trigger assembly. The trigger assemblies include a trigger, a trigger spring, a trigger bar with a connector protrusion for cooperation with a connector that can be inserted into the trigger housing, and the trigger bar is formed to cooperate with a pawl mount, and a sear is provided to cooperate with the firing pin flag.

22 Claims, 9 Drawing Sheets

(56) References Cited

U.S. PATENT DOCUMENTS

| | | | | |
|---|---|---|---|---|
| 10,228,207 | B2 | 3/2019 | Novak | |
| 10,422,602 | B2 * | 9/2019 | Theiss | F41C 3/00 |
| 11,796,265 | B2 * | 10/2023 | Vaughan | F41A 19/10 |
| 2006/0248772 | A1 * | 11/2006 | Curry | F41A 19/28<br>42/69.02 |
| 2013/0340309 | A1 * | 12/2013 | Lee | F41A 19/10<br>42/69.01 |
| 2015/0292828 | A1 * | 10/2015 | Nebeker | F41A 17/46<br>42/69.01 |
| 2017/0184366 | A1 | 6/2017 | Zajk | |
| 2018/0187994 | A1 | 7/2018 | Carr | |
| 2019/0041151 | A1 | 2/2019 | Folk | |
| 2021/0222980 | A1 * | 7/2021 | O'Clair | F41A 19/12 |
| 2023/0251050 | A1 * | 8/2023 | Fellows | F41A 17/46<br>42/69.01 |

FOREIGN PATENT DOCUMENTS

| | | | |
|---|---|---|---|
| EP | 0077790 | B1 | 7/1986 |
| EP | 1759162 | B1 | 5/2008 |
| EP | 2171388 | B1 | 3/2013 |
| EP | 2884218 | B1 | 9/2016 |

* cited by examiner

Fig. 4A *B-B´*
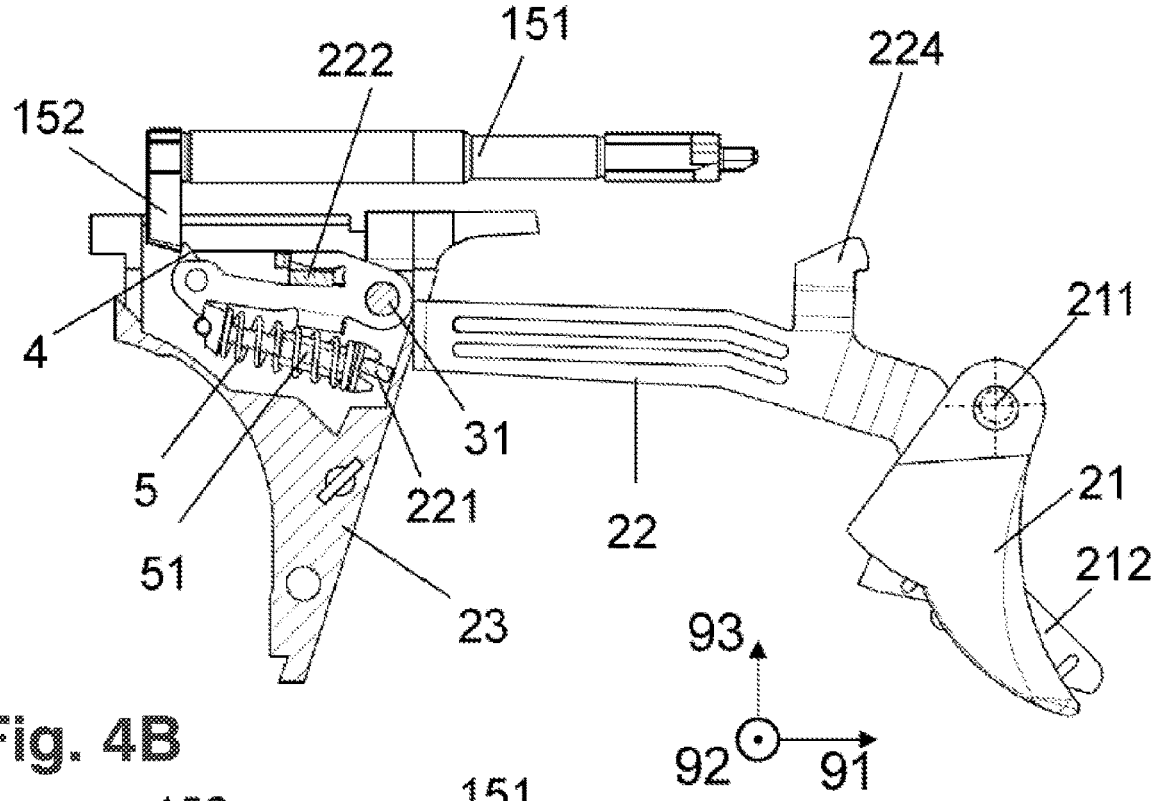
Fig. 4B
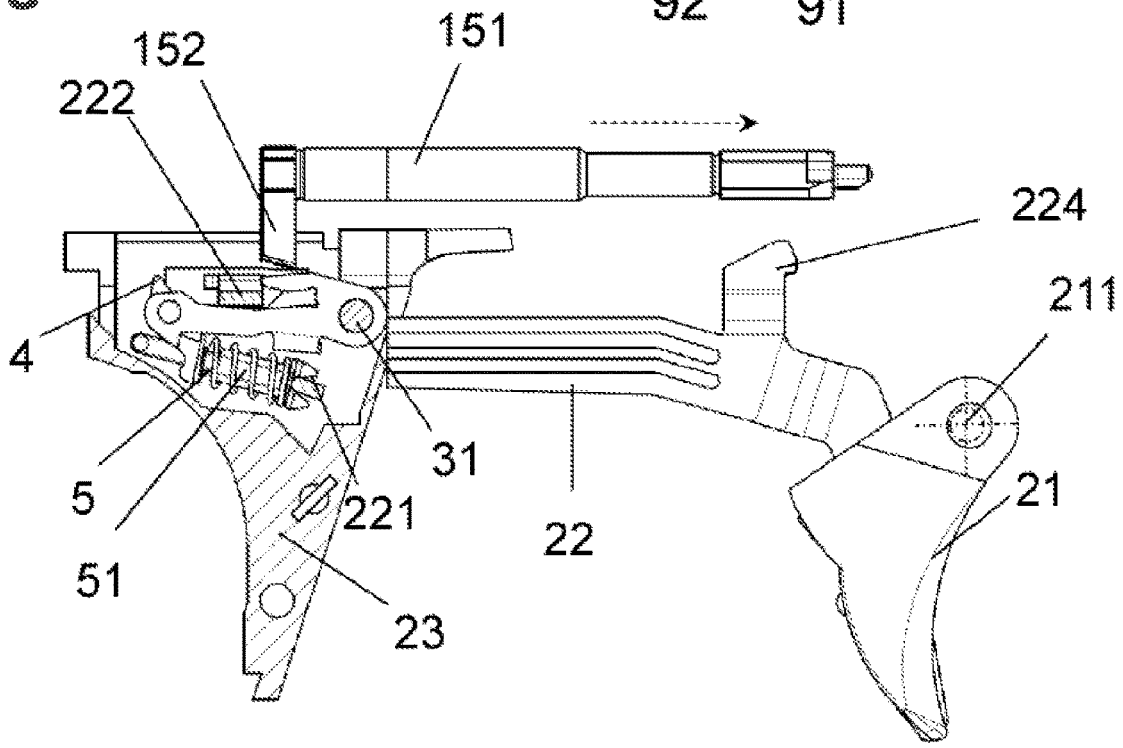

Fig. 6A
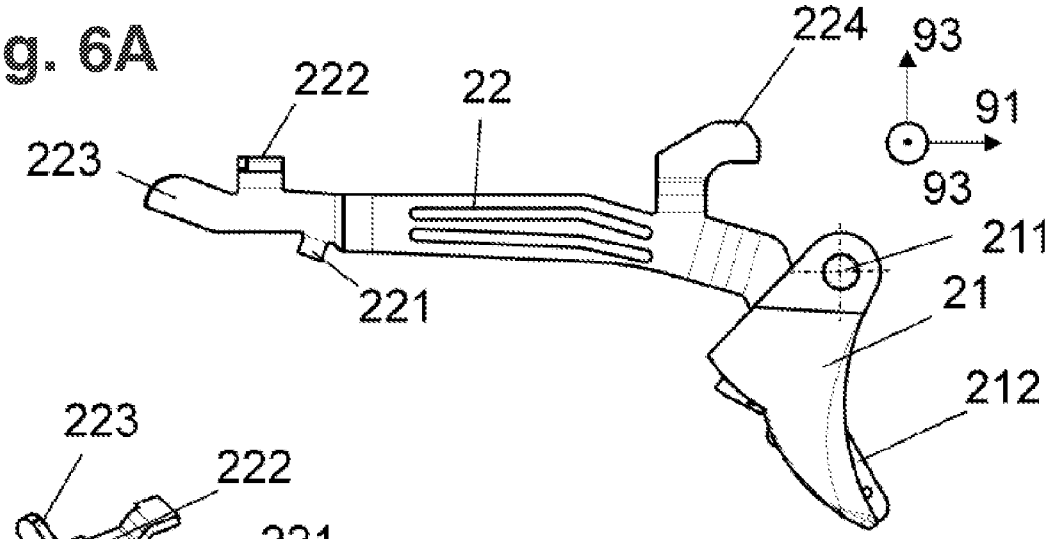
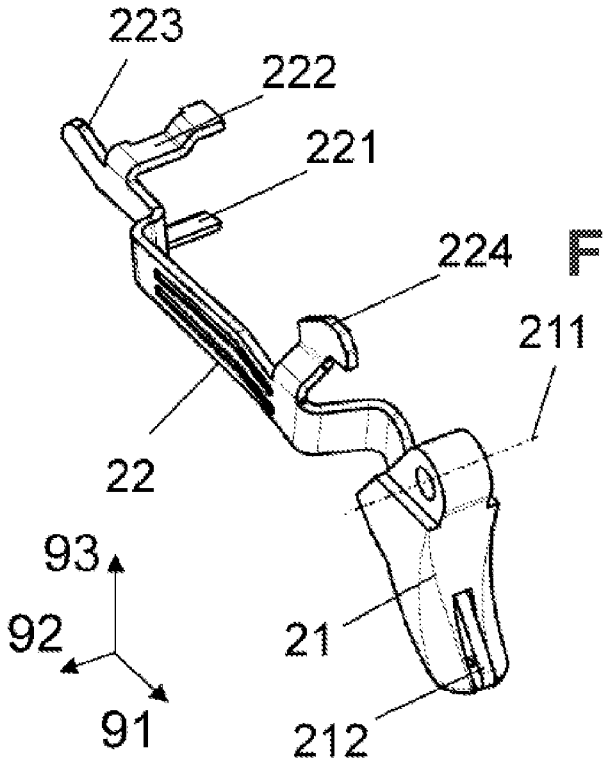
Fig. 6B
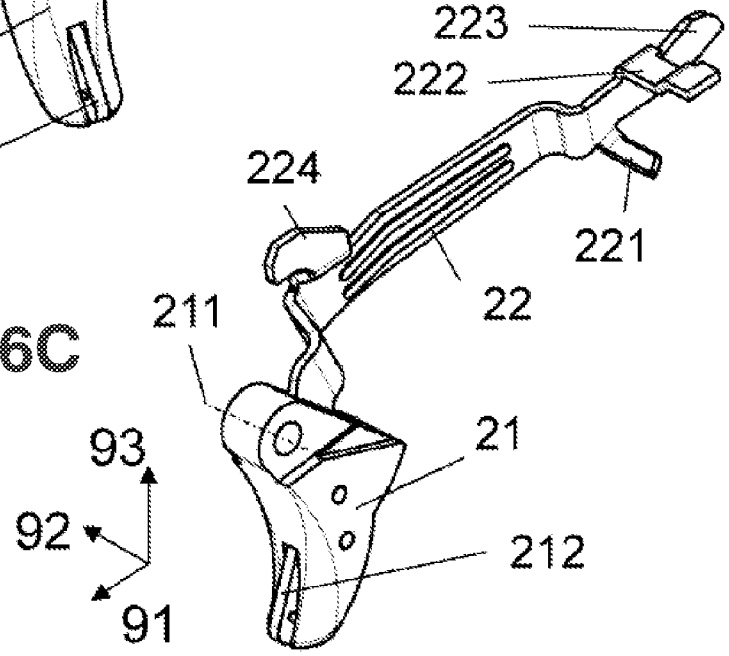
Fig. 6C

TRIGGER ASSEMBLY FOR A FIREARM

TECHNICAL FIELD

The present disclosure is directed to firearms, more particularly to trigger assemblies for firearms, and even more particularly to trigger assemblies for pistols.

BACKGROUND

The trigger assembly of a firearm is the mechanism by which the user of the firearm fires a shot. More precisely, by pressing on a trigger, the shooter releases a mechanical lock in the movement path of a spring-loaded firing pin is released, and the firing pin is accelerated onto the primer of the ammunition cartridge.

The trigger characteristics are primarily determined by the trigger path, i.e., the distance ("s") of the trigger from the rest position to the release of the firing pin, as well as by the trigger weight, i.e., essentially the sum of the forces ("F") required to effect the release of the firing pin.

A distinction is often made between firearms having double-action (DA) systems and single-action (SA) systems, but combinations or mixed forms exist as well. In the DA system, the firing pin has to be completely re-tensioned each time a shot is fired, which is usually associated with an increase in force and a comparatively long trigger path due to the complete tensioning of the firing pin spring or assembly. In DA systems, it is also necessary to overcome the force of one or more trigger springs that are intended to return the trigger assembly to the rest position. Normally, no pressure point can be felt in this regard. In SA systems, the firing pin is usually fully pretensioned, which allows for a comparatively short trigger path, and all that is required to fire the shot is to overcome the force/forces of the trigger spring(s) and/or the mechanical lock of the firing pin, which can be perceived as a pressure point.

Using the example of the widespread pistol models of the GLOCK® brand, a mixed form system has been established that is known as the SAFE ACTION system. A firing pin is partially pretensioned by the manual or automatic movement of the slide. It is only when the trigger is actuated that the firing pin spring is first fully pretensioned by means of a comparatively long trigger path, and then the movement path of the firing pin is released by lowering the locking protrusion of the trigger bar. This rod-like movement is brought about by the stop of a connector protrusion on the connector of the trigger housing and thus largely corresponds to a DA system. This sequence of movements is widely known to a person skilled in the art, and a detailed explanation is not needed here.

The increasing popularity of firearms, especially pistols, as service weapons for members of national security agencies or armed forces, in the private sector, and especially among sport and competition shooters, can lead to completely different requirements for trigger characteristics. Some pistol users prefer a DA system, in particular a partially pretensioned DA system, while other users prefer a very short trigger path and/or an exactly defined pressure point, which can be advantageous, for example, in the field of sport and competition shooting.

Numerous publications list different ways of adapting the trigger characteristics of DA and/or SA systems.

In many cases, the firing pin flag is blocked or released directly by the trigger bar or a locking protrusion of the trigger bar, as for example in EP 0077790 B1, EP 2171388 B1, U.S. Pat. No. 10,228,207 B1, EP 1759162 B1, EP 2884218 B1 or also U.S. Pat. No. 8,925,232 B2, each of which is incorporated by reference for the jurisdictions in which this is possible.

In other cases, a locking element is brought into the movement path of the firing pin instead of the trigger bar, as shown by way of example in U.S. Pat. Nos. 5,386,659 A, 7,194,833 B1 or DE 102005031927 B3. This locking element can have different shapes and is used in conjunction with a fully pretensionable firing pin to implement an SA system. The disclosure of these documents is hereby incorporated by reference for the jurisdictions in which this is possible.

Numerous DA systems, SA systems or combinations thereof are known for trigger assemblies that allow adjustment of the trigger characteristics in a targeted manner. In most cases, however, it is very difficult and often completely impossible to convert the trigger assembly in a relatively simple manner in order to switch between a DA system and an SA system or even to set the trigger characteristics such as the trigger path and/or a pressure point in a targeted manner. In addition, often a plurality of trigger springs and/or auxiliary elements are installed, as a result of which the trigger assemblies require a comparatively large number of components. Furthermore, some trigger assemblies may have the disadvantage that, in the event the firearm is bumped or dropped, the locking protrusion or locking element is removed from the path of the firing pin flag due to inertia, which may result in an unintentionally fired shot.

What is needed, therefore, is a trigger assembly which allows the trigger characteristics of a firearm to be adapted in a relatively simple manner to the needs of the shooter.

SUMMARY

The present disclosure is directed to trigger assemblies for firearms, and to firearms that include the trigger assemblies.

In one example, the disclosure is directed to a trigger assembly for a firearm, where the firearm has a striker assembly with a spring-loaded firing pin and a downwardly-protruding firing pin flag configured to cooperate with the trigger assembly. The trigger assembly includes a trigger; a trigger spring; a trigger bar that is bent twice to form a front bent section and a rear bent section; where the trigger bar is movably connectable to the trigger at the front bent section, and an end portion of the rear bent section includes a connector protrusion configured to interact with a trigger housing and a connector that can be inserted into the trigger housing, where the connector has a guidance surface for the connector protrusion; and a pawl mount, the pawl mount having a rear end section configured to receive and limit a tilting movement of a sear configured to cooperate with the firing pin flag about a laterally-extending sear axis; a front section configured to be pivotably mounted in the trigger housing about a laterally-extending mount axis; a middle section having a bearing section and an activation section, and including a catch arm formed on top of the pawl mount and protruding backward across a length of the bearing section; where the sear defines a sear plane facing the firing pin flag in an installation situation, and a bearing portion for the trigger spring on a side facing away from the firing pin flag; and the trigger bar includes a bearing protrusion that extends laterally in a direction of a center plane of the firearm from a region of the rear bent section of the trigger bar, the bearing protrusion being disposed in front of the connector protrusion and supporting a trigger spring and/or a trigger spring guide and an activation protrusion configured to interact with the pawl mount.

In another example, the disclosure is directed to firearms that include such a trigger assembly.

BRIEF DESCRIPTION OF THE DRAWINGS

FIG. 4A is a side view of an exemplary trigger assembly according to the present disclosure in the rest position; FIG. 4B is a side view of the exemplary trigger assembly in the release position.

FIG. 6A is a semi-schematic side view of an exemplary trigger bar according to the present disclosure; FIGS. 6B and 6C are perspective views of the trigger bar.

DETAILED DESCRIPTION

Figure 1A:
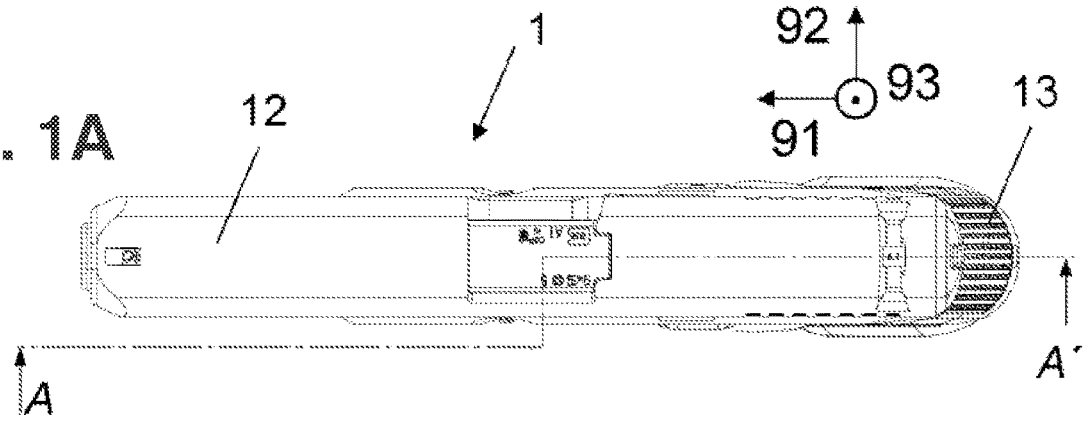
FIG. 1A is a semi-schematic plan view of an exemplary pistol according to the present disclosure indicating a sectional plane A-A'.

Selected examples of the trigger assemblies of the present disclosure enable a relatively simple conversion between SA and/or DA systems, each with or without a pressure point. Selected examples of the trigger assemblies of the present disclosure ensure the highest possible reliability during operation. Selected examples of the trigger assemblies enable existing pistol models to be retrofitted with a trigger assembly of the present disclosure. Selected examples of the trigger assemblies of the present disclosure reduce the risk of an unintentional discharge in the event that a firearm equipped with the trigger assembly is bumped or dropped. Furthermore, the selected examples of the trigger assemblies of the present disclosure include a minimum number of components, and thereby provide time- and material-optimized production.

To successively achieve these advantageous objectives, a trigger assembly is disclosed that is suitable for firearms, in particular pistols, that have a striker assembly with a spring-loaded firing pin and a downwardly protruding firing pin flag that interacts with the trigger assembly. The trigger assembly of the present disclosure comprises a trigger, a trigger spring, a trigger bar, which is bent twice, movably connectable to the trigger in its front bent region and which comprises an end section with a connector protrusion for interacting with a connector at its rear bent section, a trigger housing, and a connector that can be inserted into the trigger housing with a guidance surface for the connector protrusion. Furthermore, the trigger bar of the present disclosure comprises, in the region of the rear bent section in front of the connector protrusion, a laterally curved bearing protrusion in the direction of the firearm's center plane to support a trigger spring guide and an activation protrusion for interaction with a pawl mount. In addition, the pawl mount comprises, on its rear section, a receiver for a sear intended to interact with the firing pin flag.

The pawl mount can be shaped in this region in such a way that it limits a tilting movement of the sear about a sear axis that runs in the lateral direction of the firearm. Furthermore, the pawl mount is designed to be pivotably mounted, at its front section in the trigger housing, about a mount axis running in the lateral direction. In addition, the pawl mount has a middle section which comprises a bearing portion and an activation section that adjoins on the rear. In addition, a catch arm protruding in the rear over the length of the bearing portion is formed on the top of the pawl mount. The sear has a sear axis facing the firing pin flag in the installation situation and a bearing portion for the trigger spring on the side facing away from the sear axis.

The aforementioned objectives can now be achieved through the interaction of the elements mentioned above.

Thus, the total number of components of the trigger assembly can be kept relatively small. All that is required, for example, is a trigger spring which is pressure-loaded in the installed state and, as a result, can be expected to have a longer service life compared to a tensile load, and which also fulfills several functions. On the one hand, the functionality of the firearm during operation can be ensured, and, on the other hand, the trigger can be brought back into the starting position by the spring force after having been released by the shooter's finger. On the other hand, the slide movement and the interaction with the connector causes the trigger bar to be returned to the path of the firing pin flag by the same trigger spring, as a result of which the firing pin can be caught before the next trigger operation and pretensioned again at the same time.

The present design also allows for a relatively simple adaptation of existing firearms, for example, by replacing the existing trigger assembly with the trigger assembly according to the present disclosure. Since the pawl mount, the trigger spring, the trigger spring guide and the sear are substantially arranged within the trigger housing, a conversion of the firearm's trigger assembly may only require a replacement of the trigger bar and the trigger housing with the internal components mentioned. It is usually not necessary to convert the slide, the striker assembly or the grip/frame.

The pawl mount can be configured from a plurality of sub-elements or, preferably, formed in one piece. The pawl mount preferably has two substantially U-shaped upwardly curved legs starting from a connecting portion. The catch arm can be arranged in the manner described above on at least one or even both legs.

Another particular advantage of the trigger assemblies of the present disclosure is that an SA system, which has a "dry" trigger characteristic with a relatively short trigger path and/or trigger weight, can be realized by means of the interaction of the components. This SA system can be converted to a partially pretensioned DA system through a relatively simple replacement of the sear with a correspondingly different geometry. In addition, it is possible to use a suitable sear to create a clearly noticeable (perceptible) pressure point in the SA or DA system.

Another significant advantage over known systems is that, such a conversion can be carried out without a loss of the popular drop/jar protection because a downward movement of the pawl mount in the vertical direction in a front position of the trigger bar corresponding to a rest position can be prevented by a locking effect of the activation protrusion on the catch arm. Particularly preferably, the activation protrusion can be extended in the lateral direction in such a way that its end section engages—in a manner known per se—in a guide window in the trigger housing. In a rear position corresponding to a trigger position, however, a release of the tilting movement of the pawl mount about the mount axis is made possible.

Overall, the present disclosure provides many advantages for a variety of users who can adapt the same firearm to their needs and optimize the trigger characteristics based on the guidance of the present disclosure.

Some preferred exemplary embodiments relate, among other things, to the arrangement or design of the trigger spring, the trigger spring guide, the shape of the sear and/or the pawl mount, or also to an activation angle, as will be explained in more detail below with reference to the figures.

Further components of a firearm, in particular of a pistol, such as the grip/frame, the magazine well or the slide, are not explained in greater detail within the context of this disclosure since, based on the present description, a person skilled in the art can make modifications relatively easily based on their knowledge in the art.

The coordinate systems provided in the drawings are intended to provide a spatial orientation guide in relation to the firearm held in the hand and ready to fire in the usual way, and to denote the forward direction, i.e., in the barrel direction 91, to the side, i.e., in the lateral direction 92, and in the normal direction upward 93.

In the following, the terms left, right, up, down, front and rear always refer to the situation from a shooter's view in the barrel direction of the firearm when said firearm is held ready to fire. The weapon has a weapon center plane going through the barrel axis and oriented vertically, which, cum grano salis, forms a plane of symmetry.

FIG. 1A is a schematic representation of a firearm in a plan view. The dash-dotted line A-A' indicates the broken sectional plane along which the firearm is shown in a side view in the partial sectional representation in FIG. 1B. In the following description, the firearm is shown as a pistol 1, and the disclosed trigger assembly is explained in more detail on the basis of the function of a pistol 1. However, it is also conceivable to use the trigger assembly, according to the disclosure, in pistol caliber carbines or even in rifles, provided that these have a striker assembly 15 and/or a slide 12 which are suitable for interaction with the trigger assembly 2 according to the present disclosure.

Figure 1B:
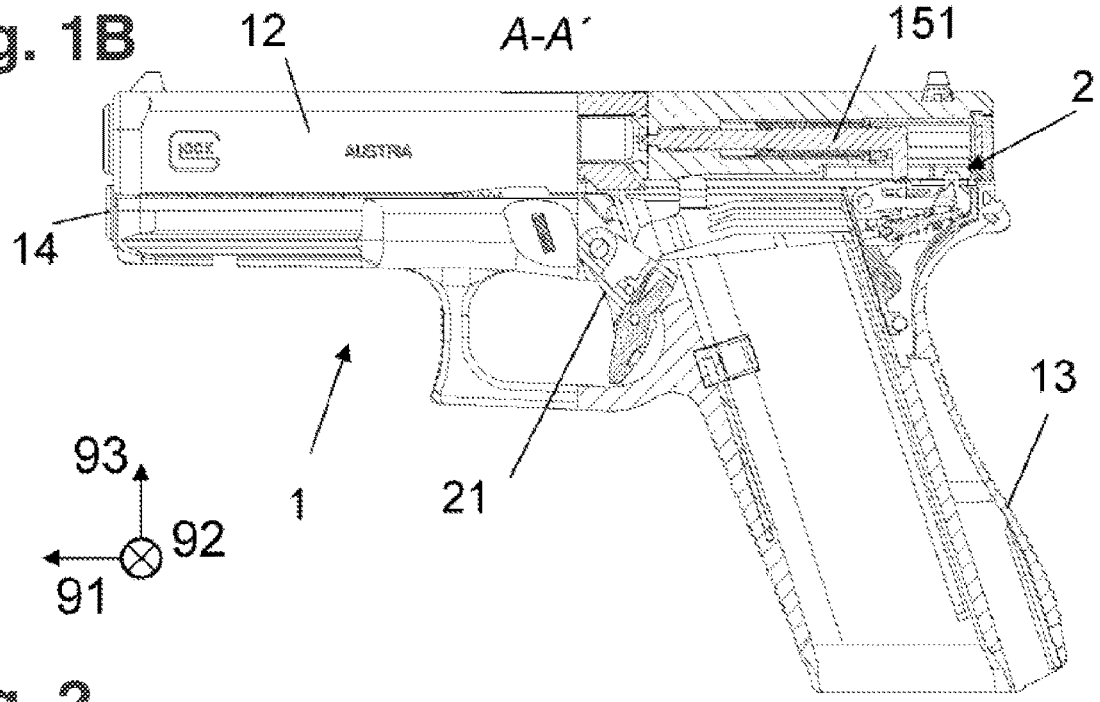
FIG. 1B is a side view of the pistol of FIG. 1A showing a partial sectional view along the sectional plane A-A'.

As can be seen in FIG. 1B, the pistol 1 comprises a slide 12, which at the same time serves as a slide and, among other things, receives the striker assembly 15. The recoil spring assembly 14 is used to bring the slide 12 into the rest position or closed position and does not need to be explained in more detail. As can be seen very clearly in the partial section, the trigger assembly 2 is positioned in the grip/frame 13 of the pistol 1. In the representation selected, the trigger, more precisely the trigger 21, is in the rear position, i.e., the release position for the trigger assembly 2, and the firing pin 151 is in its front position where it strikes the primer of an ammunition cartridge.

Figure 2:
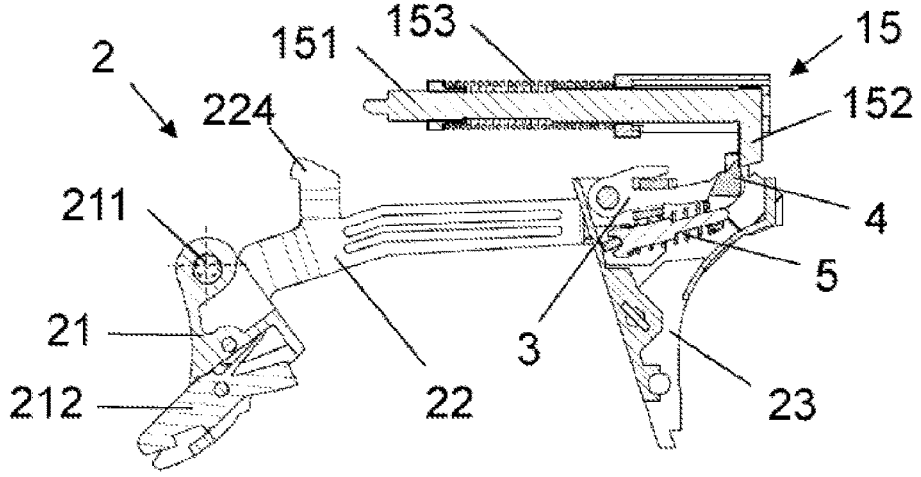
FIG. 2 is an isolated semi-schematic illustration of the trigger assembly of FIG. 1B.

FIG. 2 is an isolated illustration of a trigger assembly 2, according to the present disclosure, in a sectional view of the sectional plane A-A' from FIG. 1A, but the trigger assembly 2 is shown here in the ready-to-use position with the firing pin 151 cocked. As in the prior art, the trigger assembly 2 comprises a trigger 21, a trigger spring 5, a trigger bar 22 with a connector protrusion 223, and a trigger housing 23 with a connector 232.

The trigger bar 22, bent twice (FIGS. 3A and 3B), is movably connectable to the trigger 21 in its front bent section 22*a* and has an end section with the connector protrusion 223 for interacting with the connector 232 on its rear bent section 22*b*; in comparison, see FIGS. 6A-6C. A firing pin safety cam 224 is formed on the upper side of the trigger bar 22, which, in a known manner, releases, when the trigger 21 is actuated, a firing pin safety before the shot is fired. The trigger 21 is positioned in the grip/frame 13 so as to be pivotable about a trigger axis 211. This illustration also shows the trigger safety 212, which is known to a person skilled in the art and therefore does not need to be explained in more detail. The connector 232, which has a guidance surface 233 for the connector protrusion 223, can be inserted or plugged into the trigger housing 23. The mode of operation of the connector 232 in cooperation with the connector protrusion 223 of the trigger bar 22 is quite known to a person skilled in the art. For a more detailed explanation, reference is made; inter alia, to EP 0077790 B1.

The trigger assembly 2 is designed to interact with the firing pin 151 of the striker assembly 15. As can be seen, the firing pin spring 153 can be arranged around the firing pin 151 and is in a (partially) pretensioned state. The trigger spring 5 is supported on one side on the sear 4 and tries to push it upward. Instead of—as in many known cases—blocking the movement path of the firing pin 151 with a locking protrusion of the trigger bar 22, a locking element, in this specific case the sear 4, engages with the firing pin flag 152 and blocks the firing pin 151 in its movement path. The sear 4 is received in the pawl mount 3 and can be brought downward out of the movement path of the firing pin 151 when the trigger assembly 2 is actuated. Using a synopsis of the remaining figures, in particular with FIGS. 3A and 3B as well as FIGS. 4A and 4B, the function of the trigger assembly 2 will now be explained in more detail.

Figure 3A:
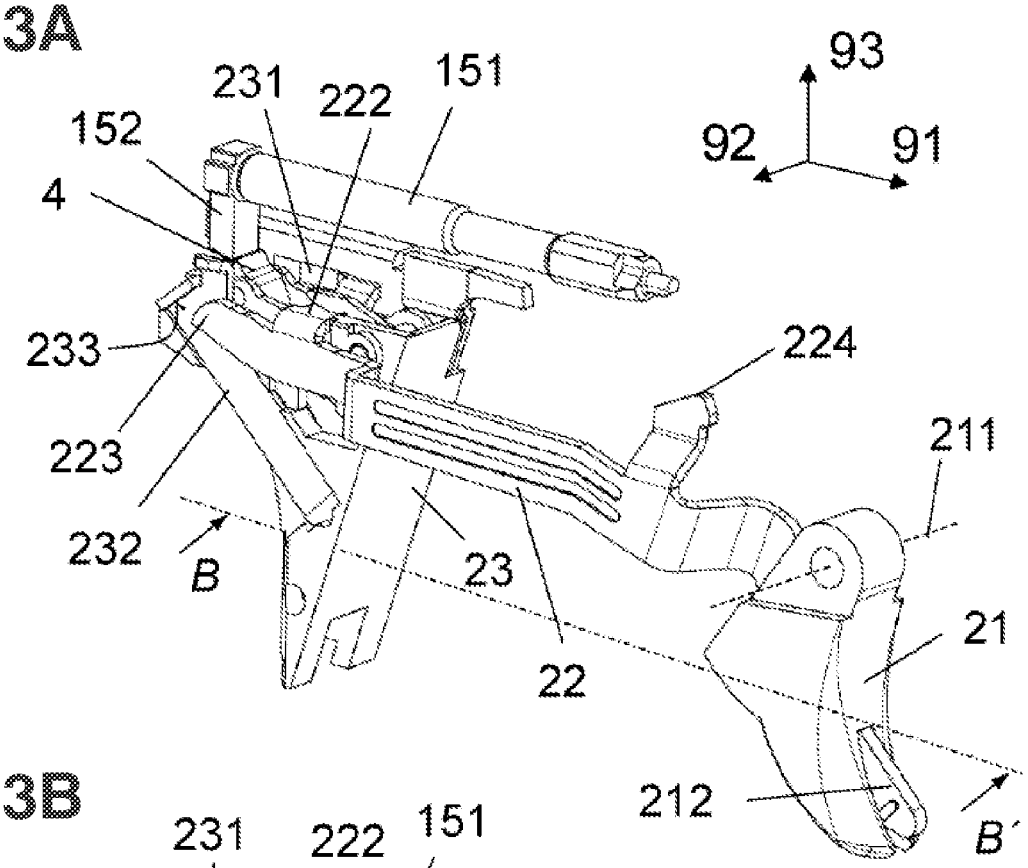
FIG. 3A is a perspective view of an exemplary trigger assembly according to the present disclosure in the rest position.

FIGS. 4A and 4B show a partially sectioned view through the trigger housing 23, approximately at the level of the sectional line B-B' in FIG. 3A, which is why the connector 232 cannot be seen in either figure.

In the region of the rear bent section in front of the connector protrusion 223, the trigger bar 22 has a bearing protrusion 221, which is bent in the direction of the central plane of the pistol 1, to support the trigger spring 5. A trigger spring guide 51 is provided in order to hold or guide the trigger spring 5 in the correct position when loaded or unloaded. The trigger bar 22 also has an activation protrusion 222 for interacting with a bearing section 331 and/or activation section 332 of the pawl mount 3; see, inter alia, FIGS. 6A-6C.

Figure 7A:
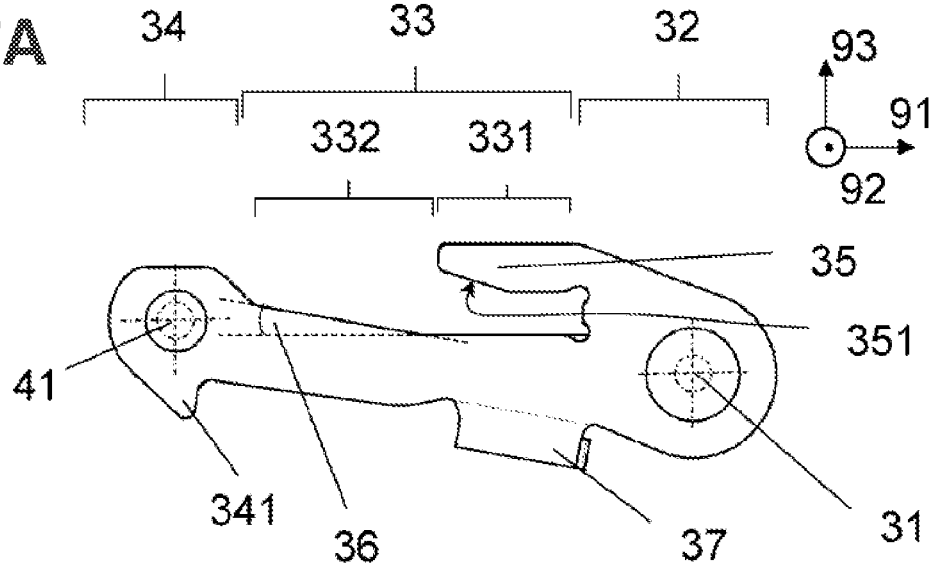
FIG. 7A is a semi-schematic side view of an exemplary pawl mount according to the present disclosure.
Figure 7B:
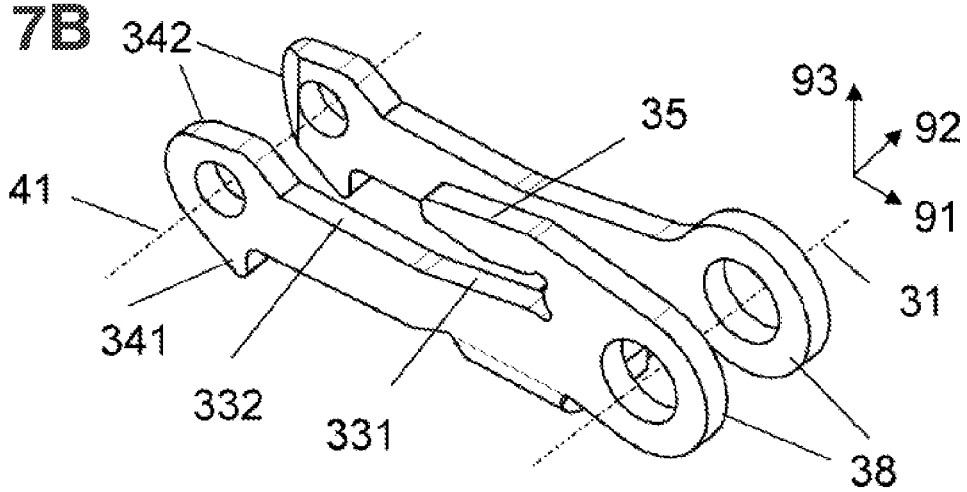
FIGS. 7B and 7C are perspective views of the pawl mount.
Figure 7C:
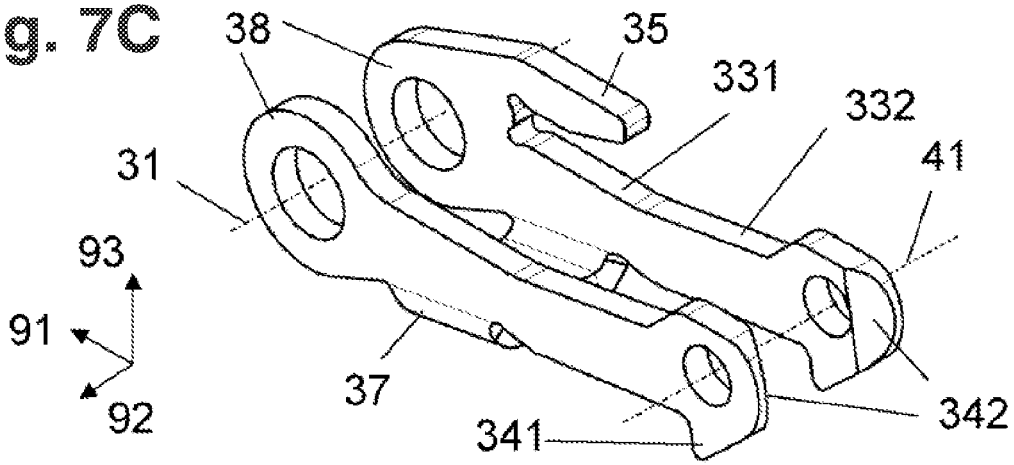

The pawl mount 3 can be designed in one piece, for example as a cast part, a stamped/bent part or 3D printed part—see also FIGS. 7A-7C—or be formed from several parts. In the illustrations selected, the pawl mount 3 is designed in one piece and comprises a connecting portion 37, from which two substantially U-shaped legs 38 are bent upward. The rear end section 34 of the pawl mount 3 is designed to accommodate and limit the tilting movement of the sear 4 provided for an interaction with the firing pin flag 152 about a sear axis 41 running in the lateral direction 92.

Figure 5:
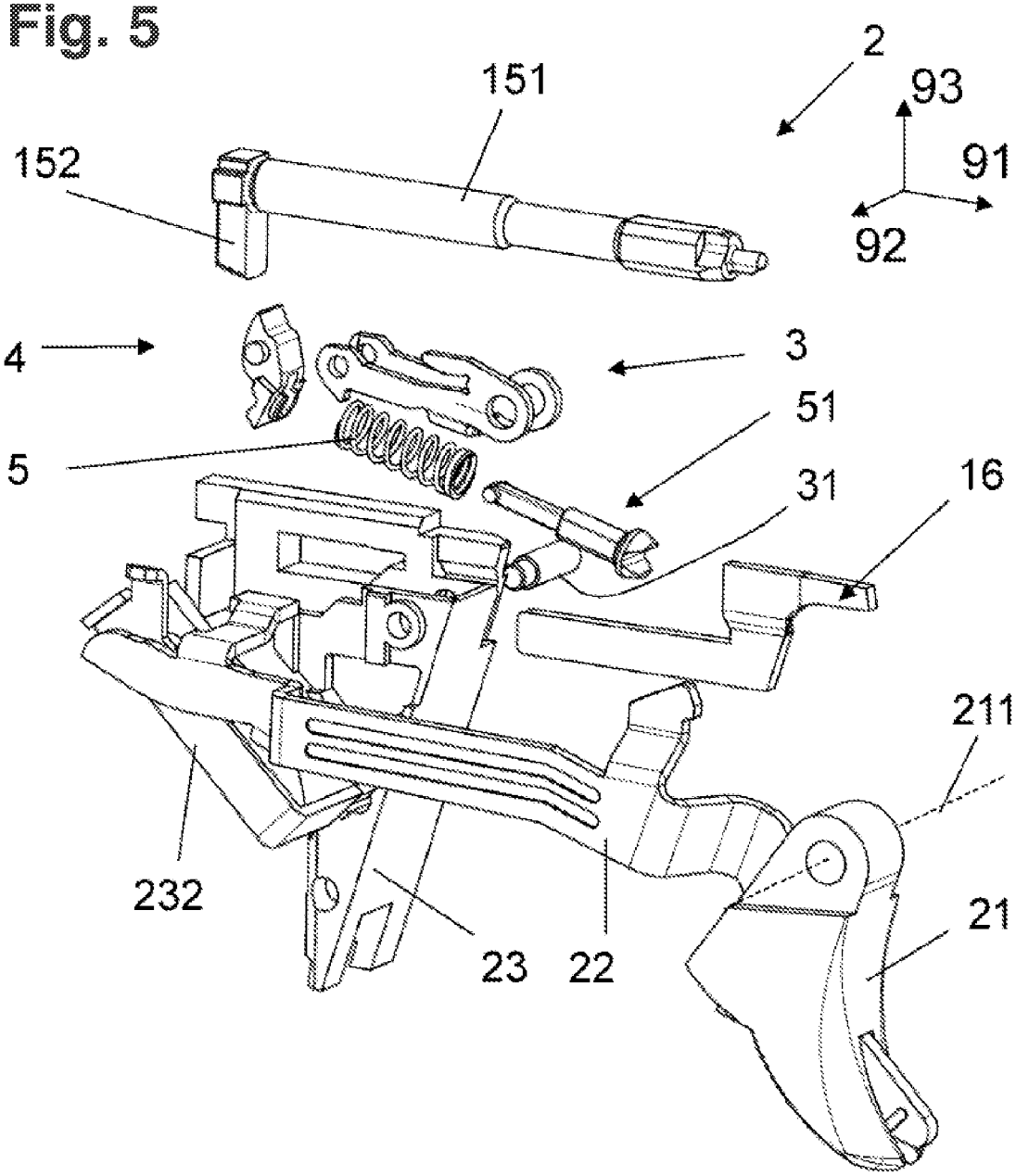
FIG. 5 is an exploded schematic view of an exemplary trigger assembly according to the present disclosure.

The front section 32 of the pawl mount 3 is designed to be pivotably mounted in the trigger housing 23 about a mount axis 31 running in the lateral direction 92. As shown in FIG. 5, the mount axis 31 can be designed as a pin or a bearing pin, for example. This way, by removing the trigger housing 23, the trigger assembly 2 can be completely removed from the grip/frame 13 and replaced. The middle section 33 of the pawl mount 3 has a bearing section 331 and an activation section 332 which adjoins in the rear, that is to say in the rest position counter to the barrel direction 91. As also shown in all of the figures, the activation section 332 can preferably be inclined upward by a defined activation angle 36 relative to the bearing section 331. In addition, a catch arm 35 protruding in the rear over the length of the bearing section 331 is formed on the top of the pawl mount 3. The catch arm 35 is preferably arranged on at least one leg 38 of the pawl mount 3 and can also be formed on both legs 38 in order to increase the symmetry and the introduction of force. The components just mentioned can also be seen clearly in the exploded view in FIG. 5.

The trigger assembly in FIGS. 3A and 4A is in the rest position, the trigger 21 in the front position and the firing pin flag 152 is blocked by the sear 4. This position essentially corresponds to a rest position with the firing pin spring 153 (not shown) being at least partially pretensioned, preferably fully pretensioned, as will be explained later.

Figure 3B:
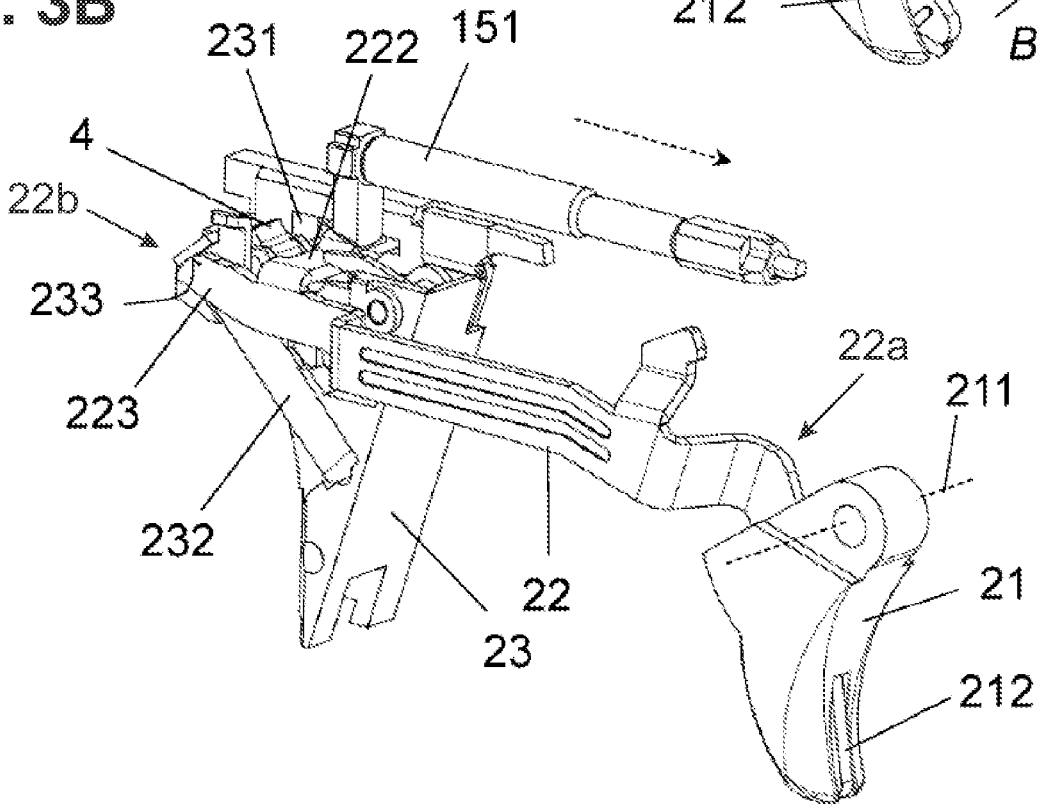
FIG. 3B is a perspective view of the exemplary trigger assembly in the release position.

The trigger assembly 2 in FIGS. 3B and 4B is in the trigger position in which the sear 4 has released the firing pin flag 152, and the firing pin 151 is accelerated in the direction of the dashed arrow along its movement path.

The pawl mount 3 is rotatably mounted in the trigger housing 23 about a mount axis 31 and is pressed in the upward direction 93 by the action of the trigger spring 5, which, on one side, supports itself on the sear 4. The other side of the trigger spring 5 is supported on a specially provided bearing protrusion 221 of the trigger bar 22, see FIGS. 6A-6C for comparison in this regard. The shape of the pawl mount 3, in cooperation with the flat support of the activation protrusion 222, limits the upward rotation of the pawl mount 3. In the rest position, the activation protrusion 222 is located in the region of the bearing section 331. A downward movement of the pawl mount 3 in the vertical direction, for example due to a shock or impact, can be prevented in the front position, i.e., the rest position of the trigger bar 22, by a blocking effect of the activation protrusion 222 on the catch arm 35. Additionally, and as is known from the prior art, it may be preferred to make the activation protrusion 222 in a width in lateral direction 92 that it protrudes with its end segment in a guide window 231 on the opposite side of the trigger housing 23 and may be guided respectively temporary housed there. In rest position, due to the housing of the activation protrusion 222 in the trigger housing 23, the danger of an unintentional lowering of the trigger bar 22 is additionally prevented. It is evident for the man skilled in the art that, in order to come to the function of a drop/jar protection, the tolerances of the components involved have to be observed meticulous.

By actuating the trigger 21, the trigger bar 22 is moved substantially in a straight line to the rear. As a result, the activation section 222 of the trigger bar 22, which is bent in the direction of the center plane of the weapon, is also moved backward and moves out of the bearing section 331 into the adjoining activation section 332. This activation section 332 can adjoin in a straight manner or preferably be inclined upward by a defined activation angle 36 relative to the bearing section 331. As a result of the backward movement of the trigger bar 22, a downward movement of the pawl mount 3 against the spring force of the trigger spring 5 is now initiated via the activation protrusion 222. This backward movement is guided in a known manner by the connector protrusion 223 of the trigger bar 22, which interacts with the guidance surface 233 of the connector 232. By suitably designing the connector 232 or the angular position of the guidance surface 233 relative to the connector protrusion 223, a lowering of the trigger bar 22 and thus of the pawl mount 3 can be specified in a targeted manner. In a rear position of the activation protrusion 222 corresponding to a trigger position, the tilting movement of the pawl mount 3 about the mount axis 31 is also completely released when the activation protrusion 222 is completely outside the blocking effect of the catch arm 35.

As can be seen very well from the synopsis of FIGS. 3B and 4B, the sear 4 has a sear plane 42 facing the firing pin flag 152 in the installation situation. As a result of the downward tilting of the pawl mount 3, the sear 4 received therein is brought downward out of engagement with the firing pin flag 152—the shot is fired. It can also be clearly seen that, when the shot is fired, the trigger spring 5 is compressed by the backward movement of the bearing protrusion 221 of the trigger bar 22. The trigger spring 5 is continuously supported on the sear 4 in the lower region, that is, below the sear axis 41, on a side substantially facing away from the sear plane 42 on a bearing portion 43.

After the shot has been fired, the return movement of the slide 12 causes a deflection of the connector 232 in the lateral direction 92 toward the center plane of the pistol 1, whereby the trigger bar 22 is pushed up again by the trigger spring 5 and the sear 4 returns to the path of the firing pin 151. This process can also take place if the trigger 21 is held down. As mentioned at the beginning, a rod in the slide 12 responsible for controlling the movement of the connector 232 is known from prior art and is not detailed again with reference to the description of EP 0077790 B1.

At this point it should be mentioned briefly that the sear 4 is designed in such a way that it can perform a limited rotation about the sear axis 41 on one side (FIG. 7C). While a rotation of the sear 4 is impaired when there is pressure on the sear plane 42 due to the bearing against the pawl mount 3, a predetermined rotation in the opposite direction is made possible. The angular range can preferably be between 10° and 25°, particularly preferably between about 15-20°, in particular 17°. This configuration is helpful when the striker assembly 15 is unstressed and the slide 12 has to be pulled back manually in order to tension the firing pin spring 153 and to get the firing pin flag 152 behind the sear 4, although the pawl mount 3, in particular the catch arm 35, interacting with the activation protrusion 222 impairs a downward movement of the sear 4. This situation can arise when the trigger assembly 2 is actuated without ammunition (e.g., "dry fire") or an ignition impairment of the ammunition cartridge does not initiate recoil-induced movement of the slide 12. After the trigger finger is removed from the trigger 21, the trigger 21 is brought forward by the force of the trigger spring 5, but—as described above—the pawl mount 3 is pushed upward, which, in cooperation with the activation protrusion 222 and the catch arm 35, causes a downward movement of the pawl mount 3 to be impaired. The special design now makes it possible that the sear 4 does not exert a significant locking effect on the firing pin flag 152 during the manual tensioning process although the pawl mount 3 remains in its rest position and does not give way downward. The sear 4 can be tilted backward by the specified angle of 10° to 25°, preferably 15° to 20°, in particular 17°, and facilitates a simple and material-saving loading process.

For the sake of completeness, it should be further explained at this point that the trigger assembly 2, according to the present disclosure, only has one trigger spring 5 to coordinate all movement sequences and carry them out as described. The trigger spring 5 could theoretically also be supported directly on the bearing protrusion 221. However, it has proven to be advantageous if the trigger spring 5 is guided in a technically sensible manner in order to reduce the risk that the trigger spring 5 may slip. The trigger spring guide 51 is therefore not limited to the shown preferred embodiment, i.e., a trigger spring guide 51 that is arranged on the inside. It is also conceivable that the trigger spring guide 51 is designed as a tubular guide with an internal trigger spring 5.

A trigger spring guide 51 arranged on the inside is preferable since it can be installed in a very space-saving manner and is also very reliable. The internal trigger spring guide 51, however, requires the presence of a through opening 44 on the bearing portion 43 of the sear 4 in order to allow for a backward evasion when the trigger 21 is actuated. This fact can be seen very well by comparing FIGS. 4A and 4B, reference signs in FIGS. 7C and 8C.

The advantages of the present trigger assembly 2 mentioned at the beginning are additionally enhanced by the relatively simple design of the essential components and their space-saving arrangement in the trigger housing 23. Further advantages were described in the following description of potential optional embodiments.

As can be seen in FIG. 5, as well as FIGS. 9A-9B and FIGS. 10A-10B, a collar 46 can be provided to further improve the mounting of the trigger spring 5 on the sear 4 or the bearing portion 43 that faces the bearing protrusion 221 when considered in the installation situation. This collar 46 can bring about an improved limitation of the clearance of the trigger spring 5 on the bearing portion 43, which reduces the risk that the trigger spring 5 slips sideways. This way, the dynamic functionality of the trigger assembly 2 can be improved. As shown by way of example in FIG. 9B and FIG. 10B, the delimitation can be substantially circular. The diameter of the limitation can be smaller or larger than the diameter of the trigger spring 5 in this region. Likewise, individual protrusions can also be formed as a collar 46 with the same effect.

Figure 8A:
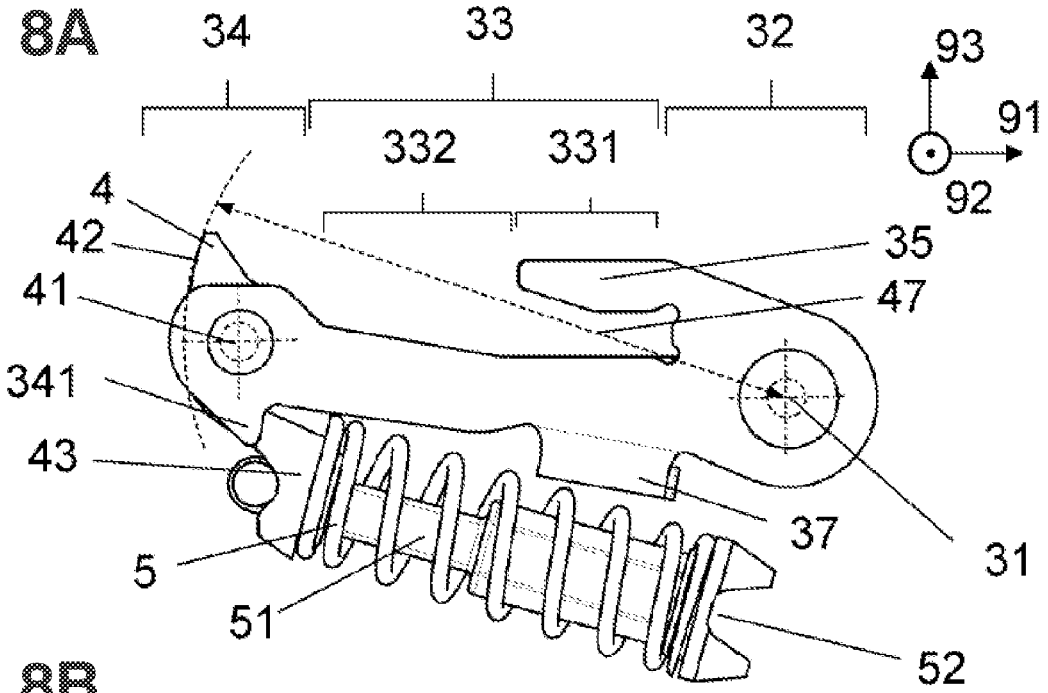
FIG. 8A is a semi-schematic side view of an exemplary pawl mount with a sear, trigger spring guide, and trigger guide according to the present disclosure.
Figure 8B:
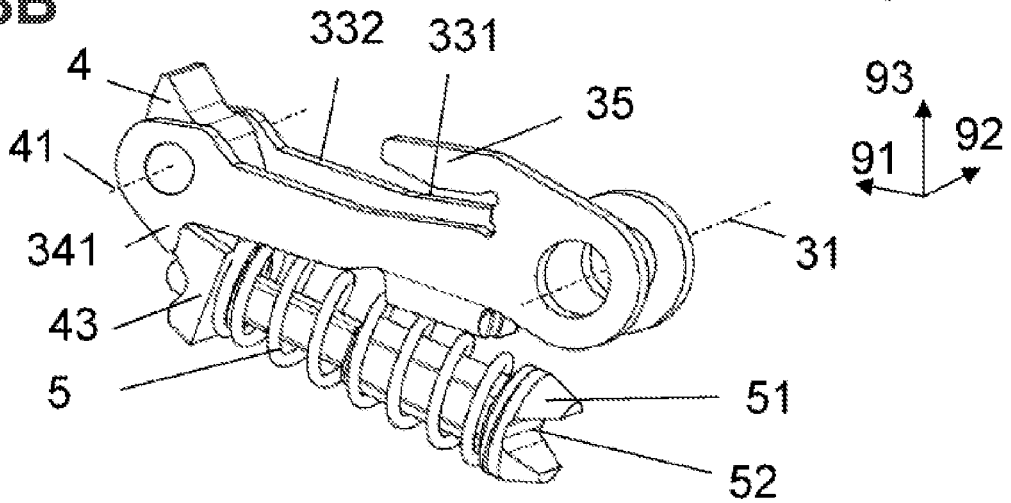
FIGS. 8B and 8C are perspective views of the pawl mount, sear, trigger spring guide, and trigger spring.
Figure 8C:
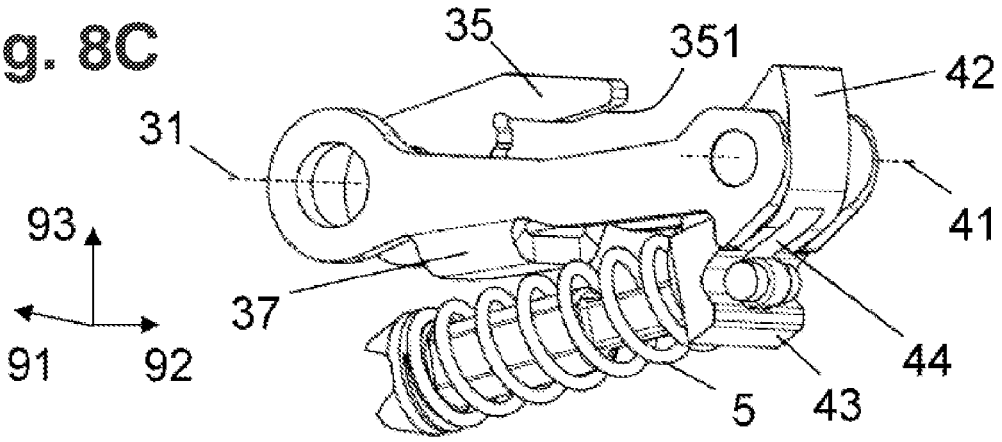

Another particularly preferred embodiment can be seen very clearly from the combination of FIGS. 4A-4B with FIGS. 8A-8C, according to which the trigger spring guide 51 has a fork-shaped recess 52 at its end facing the bearing protrusion 221. It is also conceivable to design the mounting of the trigger spring guide 51 in a manner similar to that of a connecting rod eye, but the advantage of a recess 52 is that it is easier to assemble.

In addition, it can be advantageous if, when using an internal trigger spring guide 51, this guide has a locking contour at its end facing the bearing portion 43, which prevents an automatic disassembly after the insertion or penetration of the through opening 44 in the bearing portion 43. The through opening 44 can be designed as a slot or a hole, with or without an opening at the bottom. Although other geometries, such as a ball head or similar shapes in cooperation with a correspondingly adapted through opening 44, are conceivable as well, it has proven to be advantageous if the said end has a T-shape. Refer, for example, to FIGS. 8B and 8C in conjunction with FIG. 5, FIG. 9B and FIG. 10B. It allows for a relatively simple installation of the trigger spring 5 by sliding it onto the trigger spring guide 51, inserting and rotating the trigger spring guide 51 through the through opening 44. In the installed state, the desired locking effect is produced toward the front, as a result of which the trigger assembly 2 as a whole is easier to remove or replace.

Furthermore, it can be advantageous if the sear 4 on the bearing portion 43 has a slot-shaped through opening 44 that is preferably closed at the bottom when viewed in the installation situation. As indicated above, the use of a ball head or similar mounts would also be suitable for blocking the trigger spring guide 51 toward the front after the trigger spring guide 51 has been inserted into the through opening 44 from below, for example. However, if the through opening 44 is designed to be closed at the bottom, this subassembly can be removed together with the pawl mount 3 or the sear 4, which allows for a faster conversion when changing the sear 4, for example.

In certain cases, it can be advantageous to adapt the trigger characteristics of the pistol 1 to the needs of the user by optimizing the matching of the aforementioned components. One possibility consists in adapting the inclination of the guidance surface 233 in a manner known per se by exchanging a correspondingly shaped connector 232 in such a way that the trigger pull weight is increased or decreased. Another possibility for adjusting the trigger pull weight is to use trigger springs 5 of different strengths. This is relatively easy to do with the present trigger assembly 2.

In addition, due to the optimized inclination of the trigger spring guide 51 relative to the sear 4, the lowering force required when firing a shot can be adjusted. To this purpose, the arrangement of the bearing protrusion 221 on the trigger bar 22 can contribute to the trigger pull weight. As can be seen very well from FIGS. 6B and 6C, the bearing protrusion 221 on the underside of the trigger bar 22 is bent in the rear bent section, but in front of the connector protrusion 223 and in front of the activation protrusion 222, in the direction of the weapon center plane. The closer to the rear the bearing protrusion 221 is formed at the level of the activation protrusion 222; the steeper the inclination of the trigger spring 5 or a trigger spring guide 51 is in the installation situation, which increases the trigger pull weight. Compare in this regard with FIG. 2 and FIGS. 4A-4B.

The provision of a previously described activation angle 36 between the activation section 332 and the bearing section 331 can be seen as a further possibility of adjusting the trigger pull weight. The greater the activation angle 36, the greater the lowering of the pawl mount 3 during the backward movement of the trigger bar 22. It has proven to be advantageous if the activation angle 36 of the activation section 332 relative to the bearing section 331 is between 1° and 25°, preferably 5° to 15°. Particularly preferably, the activation angle 36 is substantially 10°. If pawl mounts 3 with different activation angles 36 are provided, the user can adapt the trigger characteristics to his needs.

A particularly interesting possibility of influencing the trigger characteristics is the choice of a suitable sear 4 with a correspondingly shaped sear plane 42. As mentioned at the outset, the present trigger assembly 2 is suitable for being designed as a "pure" SA system. For this purpose, reference is made primarily to FIG. 8A in conjunction with FIGS. 9A-9B, which clearly shows that, on its rear side, the sear 4, i.e., the sear plane 42 has a convex contour. Since, when the pawl mount 3 or the sear 4 is lowered, a sliding of the firing pin flag 152 along the sear plane 42 does not result in any significant backward movement due to the rotation of the pawl mount 3, this convex shape makes it possible, in the best case, for the firing pin flag 152 to no longer be deflected backward. This way, from the point of view of the firing pin 151, there is no additional deflection to the rear, and an increasing trigger pull weight when the trigger 21 is pulled due to the additional tension of the firing pin spring 153 can be avoided. An SA system can thus be realized, as can be seen from a highly schematic illustration of a force-displacement curve in FIG. 12. In a preferred variant, the sear plane 42 has a convex contour toward the rear which, when viewed in the lateral direction 92 in the rest position, is formed such that it has constant distance 47 from the mount axis 31. This can be seen very clearly in FIG. 8A as shown by the dashed line; in comparison, see FIG. 9A.

Figure 9A:
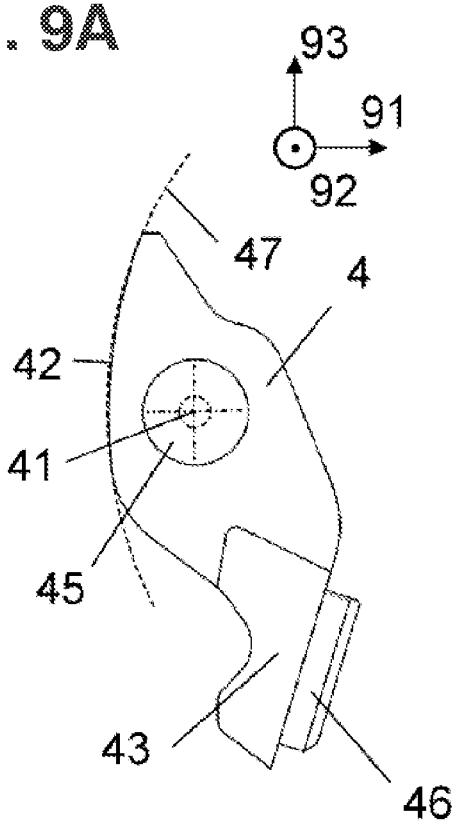
FIG. 9A is a semi-schematic side view of an exemplary sear with a convex sear axis according to the present disclosure.
Figure 9B:
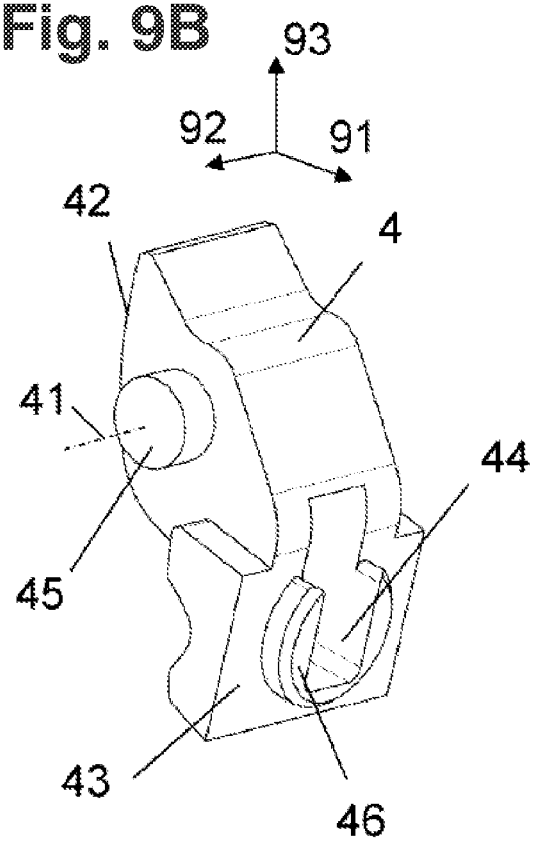
FIG. 9B is a perspective view of the sear.
Figure 10A:
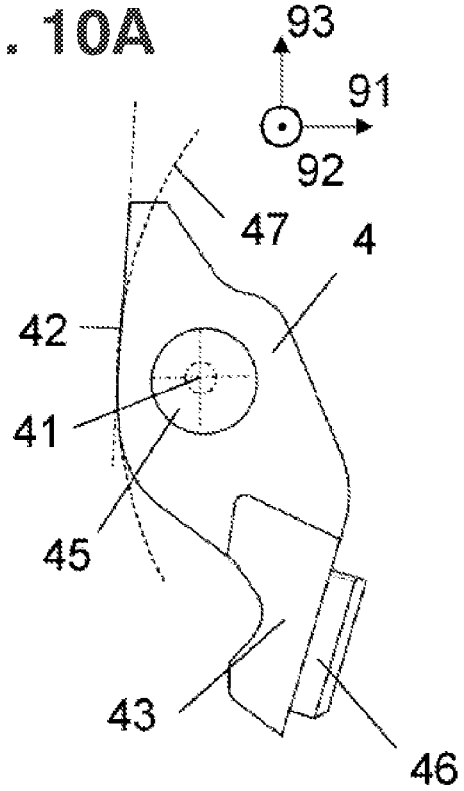
FIG. 10A is a semi-schematic side view of an exemplary sear with a straight sear axis according to the present disclosure.
Figure 10B:
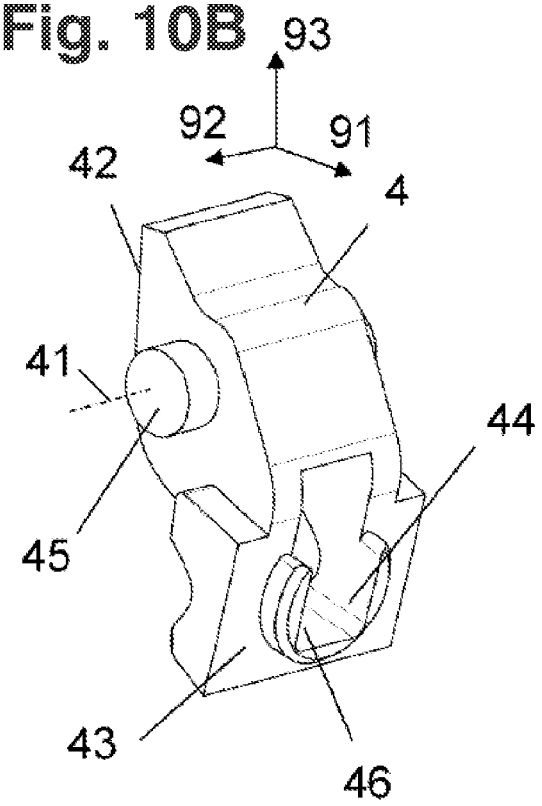
FIG. 10B is a perspective view of the sear.

Alternatively, however, it is also possible to use a sear plane 42 with a convex shape, which, in the rest position and viewed in the lateral direction 92, runs downward from the end facing the firing pin flag 152 and follows a line which, at least in parts, does not have a constant distance 47 from the mount axis 31. In particular, the shape of the sear plane 42 can, in some portions, increase or decrease the distance to the mount axis 31 relative to a constant radius or distance 47. In a borderline case, the sear plane 42 can also be designed as a flat plane with the contour substantially following a straight line in the side view. This way, an additional force or trigger pull weight is required by the tensioning of the firing pin spring 153. The greater the distance to the mount axis 31, for example greater than the constant distance 47 as mentioned above, the greater the proportion of the rotation-related backward movement of the sear 4 or the additional backward movement of the firing pin 151. In a borderline case, the sear plane 42 can at least partially form a straight line, as is shown schematically in FIG. 10(*a*) with the dot-dashed auxiliary line (the left line in the illustration). As a comparison, the constant distance 47 from FIGS. 8A and 9A is shown in FIG. 10A. The shape of the sear plane 42 can thus be specifically tailored by a person skilled in the art in order to influence the desired trigger characteristics. The sear plane 42 indicated by way of example in FIG. 10A substantially corresponds in its effect to a DA system or a partially pretensioned DA system that has long been known from GLOCK® pistols. A corresponding, noticeable twofold increase in force is indicated schematically for DA systems in FIG. 12 as the "DA" curve (b).

Figure 11A:
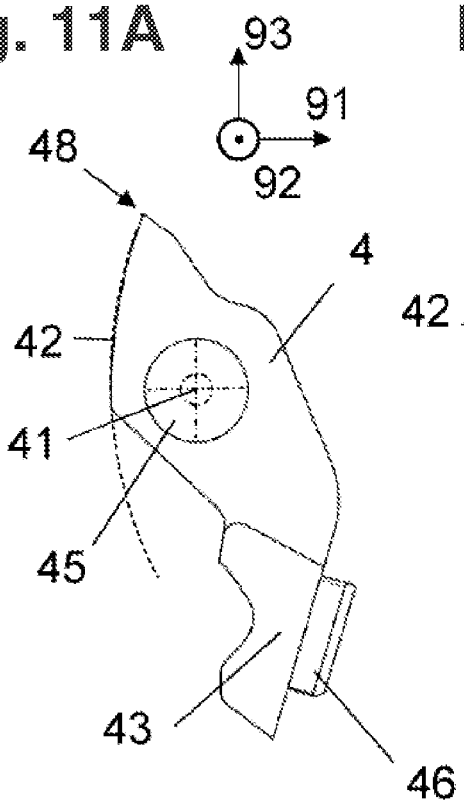
FIG. 11A is a semi-schematic side view of an exemplary sear with a sear rest according to the present disclosure.
Figure 11B:
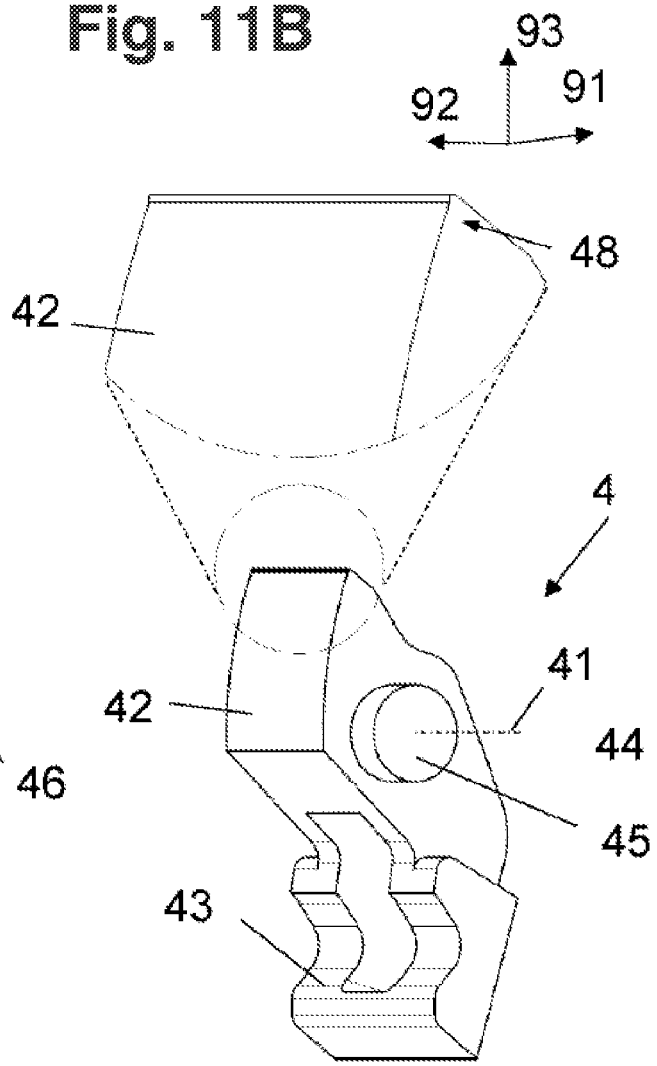
FIG. 11B is a perspective view of the sear.

Another possibility of optimizing the trigger characteristics by modifying the sear 4 or the sear axis 42 is shown schematically in FIGS. 11A and 11B. A sear rest 48 facing the firing pin flag 152 is formed on the sear axis 42. The side view in FIG. 11A shows that the sear rest 48 is substantially formed in the normal direction upward 93, whereby its height and exact angular position can, of course, be adapted by a person skilled in the art with knowledge of the present disclosure. The sear rest 48 serves as a kind of projection on which, when the sear axis 42 slides down or back and down, the firing pin flag 152 briefly comes into full contact with the sear rest 48, which is accompanied by a clearly noticeable increase in the trigger pull weight and indicates to the shooter the immediate firing of the shot as a pressure point (further referred as "DP" for "Druckpunkt" in German). As described above, such a sear rest 48 can be provided both in combinations with a sear 4 for SA as well as for DA systems. See FIG. 11B in which a detail shows an enlarged exemplary illustration of the sear rest 48 on the sear axis 42. Representing an SA system with a pressure point, a corresponding force-displacement curve is shown schematically as curve (c) in FIG. 12.

Based on the present disclosure in its entirety, a person skilled in the art can easily understand how the trigger characteristics of the trigger assembly 2 can be optimized by adapting one or more components. At this point, reference is made to FIG. 12 in which the force-displacement curves of a trigger assembly 2 with only a different shape of the sear 4 are shown in a rough schematic drawing. The main contributions of the trigger pull weight are ones limited to the aspects of the sear 4. For the sake of brevity, the influence of the above-mentioned possibilities for influencing the trigger characteristics, such as the angular position of the trigger spring 5, the activation angle 36, etc., must be applied mutatis mutandis to the respective contributions to the force-displacement curve without these having to be described in detail.

Starting from the left, when the trigger 22 is deflected by the trigger path "s," a moderate increase in the trigger force "F" can be seen, which in this region substantially corresponds to the spring force of the trigger spring 5. When the connector protrusion 223 comes into contact with the connector 232; the trigger pull weight increases significantly as a result of friction on the guidance surface 233. This increase in force is superimposed by a force component which is caused by the lowering of the pawl mount 3 and the friction of the activation protrusion 222 thereon. Subsequently, there is a third, somewhat flatter region that is characterized by the shape of the sear 4.

When using a sear 4 with a design of the sear axis 41 for SA systems, the sear 4 slides off the firing pin flag 152, as described above, in a substantially homogeneous manner and without any additional pretensioning of the firing pin spring 153. This is evident from the further, moderate increase in force of the second sub-curve, curve (a), in FIG. 12 until the release of the firing pin 151. The release of the firing pin 151 is indicated by the abrupt drop in force.

Figure 12:
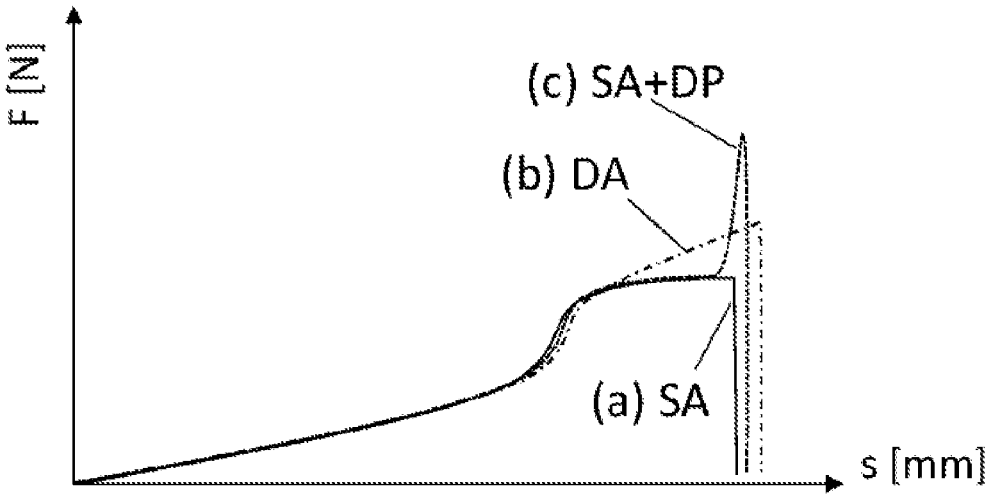
FIG. 12 is a plot showing a comparison of the force-displacement curves for an SA system (a), a DA system (b) and an SA system with a pressure point (c).

Using curve (b) in FIG. 12, the situation with a sear 4 for a DA system can be explained whereby, as described above, in addition to the force of the trigger spring 5 when the pawl mount 3 is lowered, a further force component for tensioning the firing pin spring 153 must be used whereby the second, right subregion requires a noticeably steeper increase in the trigger pull weight compared to the SA system just explained. In addition, reference should be made at this point to the—qualitatively represented—trigger path "s," which is longer than that of the SA variant.

As explained above, a sear 4 in the SA or DA version could have a sear rest 48 which, in addition to the aforementioned force contributions, can cause a clearly noticeable, abrupt increase in force when the trigger 21 is pulled. This force-displacement curve is shown by way of example as curve (c) in FIG. 12 and is combined with an SA variant of the sear 4 to represent a sear 4 in FIGS. 11A-11B. This abrupt increase in force substantially corresponds to a discontinuity in the sear axis 41, as explained above, and can be viewed as a "pressure point" (or "DP") in the illustration.

Based on the possibilities shown, the trigger characteristics can now be adjusted in a relatively simple and easily reproducible manner by selecting the appropriate sear 4.

In a further preferred embodiment, a stop 341 can be formed on the underside of the pawl mount 3 in the rear end section 34 as can be seen very clearly from FIG. 8A. This stop 341 can, for example, be designed as a projection on the underside for the targeted limitation of the tilting movement of the sear 4 about the sear axis 41. This allows for the unilateral rotation of the sear 4 about the sear axis 41 to be limited in a relatively simple way while the alternative use of additional springs or other locking elements on the pawl mount 3 or an internal projection on the trigger housing 23 would require more manufacturing effort with the same effect.

As can be seen from FIGS. 8B and 8C, the sear 4 can preferably protrude laterally below the sear axis 41 in the lateral direction 92 over the width of its accommodation in the pawl mount 3. This region of the bearing portion 43 can thus serve as a stop on the pawl mount 3 and limit the rotation of the sear 4. Based on this disclosure, it becomes clear to a person skilled in the art that there are various geometric design options that are suitable for an optimized function and/or arrangement in the trigger housing 23.

In order to facilitate the dismantling and/or interchangeability of the sear 4, as well as to reduce the total number of components, it has proven to be advantageous to provide lateral bearing protrusions 45 on the sear 4, which are used for bearing purposes in the rear end section 34 of the pawl mount 3 in corresponding recesses. This embodiment is depicted throughout the figures, see in particular FIGS. 9A-9B and FIGS. 10A and 10B, but it is also possible for the sear 4 to be held in an analogous manner by means of a bearing pin.

Furthermore, a replacement and/or assembly of the trigger assembly 2 can be simplified in that the pawl mount 3 has, on the inner surfaces, at least one taper 342 on its rear end section 34. These tapers 342 can be seen very clearly by way of example in FIGS. 7B and 7C on the inner sides of the legs 38 and facilitate the removal, but in particular the introduction of the sear 4 from the rear into the pawl mount 3.

In addition, it has proven to be advantageous if the connecting portion 37 of the pawl mount 3, viewed from the side, is arranged approximately at the level of the bearing section 331, as can be clearly seen in FIGS. 7A-7C. This way, an elastic deformation of the legs 38 in the rear end section 34 can be carried out relatively well in order, for example, to exchange the sear 4.

Some further aspects of the present disclosure relate, for example, to an increase of the dynamic functionality of the pistol 1, for example, when firing a shot quickly. Accordingly, it can be advantageous if the activation protrusion 222, as can be seen from FIG. 5 and in particular FIGS. 6B and 6C, is flat when viewed from above. This way, a wide contact surface for the pawl mount 3 can be provided, in particular in the region of the bearing portion 43 when the trigger assembly 2 is in the rest position, in order to form a drop/jar safety device as described above.

It can also be advantageous if the activation protrusion 222 is designed to be elongated in the lateral direction 92 beyond the pawl mount 3, as is shown in FIGS. 5 and 6A-6C, using the bent end of the activation protrusion 222 as an example. The end section of the activation protrusion 222 can thus engage in a guide window 231 which is provided on the trigger housing 23. A drop/jar protection can thus be realized with a correspondingly stepped guide window 231, as is known per se, in particular, in GLOCK® pistols. In the front region of the guide window 231, there is a taper compared to the rear region, due to which the activation protrusion 222 can be counter-positioned in the trigger housing 23, and a high dynamic functionality is promoted, especially during a rapid firing sequence since the activation protrusion 222 can return to the rest position in a guided manner. In a similar way, a two-sided support can also be provided with a second catch arm 35.

In order, on the one hand, to facilitate the assembly and, on the other hand, to promote the quick and precise function of the trigger assembly 2, an inlet guide 351 can be formed on at least one catch arm 35 as shown in FIG. 7A. This bevel is designed to taper toward the rear from the end of the catch arm 35 toward the front. As can be easily understood by a person skilled in the art, this way the activation protrusion 222 can move into the rest position more easily, which in turn can promote dynamic functionality when the shot is fired quickly.

The trigger assemblies disclosed herein are not limited to the illustrated and described embodiments but can be modified and configured in various ways. The cross-sectional shapes of the aforementioned moldings, rails, recesses, etc. may, in particular, be adapted to the prescribed basic data, and the lengths and the positions with respect to the frame may also be easily adapted by the person skilled in the art with knowledge of the present disclosure.

In the description and the claims, the terms "front," "rear," "above," "below" and so on are used in the generally accepted form and with reference to the object in its usual use position. This means that, for one weapon, the muzzle of the barrel is at the "front," that the slide is moved "backward" by the explosive gas, etc. Transverse to a direction essentially means a direction rotated by 90°.

It should also be noted that in the description and the claims, specifications such as the "lower area" of an object refer to the lower half and, in particular, the lower quarter of the overall height; "lowermost region" refers to the lowermost quarter and, in particular, an even smaller part, while "central region" refers to the central third of the overall height. For the terms "width" or "length," this applies mutatis mutandis. All these terms have their generally accepted meaning applied to the intended position of the object under consideration.

In the description and the claims, "substantially" means a deviation of up to 10% of the stated value if physically possible, both downward and upward, otherwise only in the appropriate direction; in the case of degrees (angle and temperature), this means ±10°. If there are terms such as "substantially constant" etc., what is meant is the technical possibility of deviation which a person skilled in the art takes as a basis and not the mathematical one.

All given quantities and percentages, in particular those relating to the limitation of the invention, insofar as they do not relate to specific examples, are understood to have a tolerance of ±10%; accordingly, for example: 11% means: from 9.9% to 12.1%. With designations such as "a solvent" or "a spring," the word "a" is not to be considered to be a numeral, but rather a pronoun unless the context indicates otherwise.

The term: "combination" or "combinations," unless otherwise indicated, stands for all types of combinations, starting from two of the relevant components up to a plurality or all of such components; the term "containing" also stands for "consisting of."

The features and variants indicated in the individual embodiments and examples may be freely combined with those of the other examples and embodiments and, in particular, may be used for characterizing the invention in the claims without necessarily including the other details of the particular embodiment or of the particular example.

List of reference numerals:

| | | | |
|---|---|---|---|
| 1 | Pistol | 232 | Connector |
| 12 | Slide | 233 | Guidance surface |
| 13 | Grip/frame | | |
| 14 | Recoil spring assembly | | |
| 15 | Striker assembly | 3 | Pawl mount |

-continued

| List of reference numerals: | | | |
|---|---|---|---|
| 151 | Firing pin | 31 | Mount axis |
| 152 | Firing pin flag | 32 | Front section |
| 153 | Firing pin spring | 33 | Middle section |
| 16 | Ejector | 331 | Bearing section |
| 2 | Trigger assembly | 332 | Activation section |
| 21 | Trigger | 34 | Rear end section |
| 211 | Trigger axis | 341 | Stop |
| 212 | Trigger safety | 342 | Taper |
| 22 | Trigger bar | 35 | Catch arm |
| 22a | Front bent section | 351 | Inlet guide |
| 22b | Rear bent section | 36 | Activation angle |
| 221 | Bearing protrusion | 37 | Connecting portion |
| 222 | Activation protrusion | 38 | Leg |
| 223 | Connector protrusion | | |
| 224 | Firing pin safety cam | 5 | Trigger spring |
| 23 | Trigger housing | 51 | Trigger spring guide |
| 231 | Guide window | 52 | Recess |
| 4 | Sear | | |
| 41 | Sear axis | | |
| 42 | Sear plane | | |
| 43 | Bearing portion | | |
| 44 | Through opening | | |
| 45 | Bearing protrusion | | |
| 46 | Collar | 91 | Barrel direction |
| 47 | Distance | 92 | Lateral direction |
| 48 | Sear rest | 93 | Normal direction upward |

The invention claimed is:

1. A trigger assembly for a firearm, the firearm having a striker assembly with a spring-loaded firing pin and a downwardly-protruding firing pin flag configured to cooperate with the trigger assembly, the trigger assembly comprising:

a trigger;

a trigger spring;

a trigger bar that is bent twice to form a front bent section and a rear bent section; wherein the trigger bar is movably connectable to the trigger at the front bent section, and an end portion of the rear bent section includes a connector protrusion configured to interact with a trigger housing and a connector that can be inserted into the trigger housing, where the connector has a guidance surface for the connector protrusion; and a pawl mount, the pawl mount having:

a rear end section configured to receive and limit a tilting movement of a sear configured to cooperate with the firing pin flag about a laterally-extending sear axis;

a front section configured to be pivotably mounted in the trigger housing about a laterally-extending mount axis;

a middle section having a bearing section and an activation section, and including a catch arm formed on top of the pawl mount and protruding backward across a length of the bearing section;

wherein the sear defines a sear plane facing the firing pin flag in an installation situation, and a bearing portion for the trigger spring on a side facing away from the firing pin flag; and the trigger bar includes a bearing protrusion that extends laterally in a direction of a center plane of the firearm from a region of the rear bent section of the trigger bar, the bearing protrusion being disposed in front of the connector protrusion and supporting the trigger spring and/or a trigger spring guide and an activation protrusion configured to interact with the pawl mount.

2. The trigger assembly according to claim 1, wherein the pawl mount includes a connecting portion having two substantially U-shaped and upwardly bent legs.

3. The trigger assembly according to claim 2, wherein the rear end section of the pawl mount includes a taper on inner surfaces of the legs.

4. The trigger assembly according to claim 1, wherein the activation section of the pawl mount is inclined upward by an activation angle relative to the bearing section.

5. The trigger assembly according to claim 4, wherein the activation angle of the activation section relative to the bearing section is between 1° and 25°.

6. The trigger assembly according to claim 4, wherein the activation angle of the activation section relative to the bearing section is between 5° and 15°.

7. The trigger assembly according to claim 1, wherein the bearing portion of the sear includes a collar facing the bearing protrusion in the installation situation.

8. The trigger assembly according to claim 7, wherein the collar facing the bearing protrusion in the installation situation is circular.

9. The trigger assembly according to claim 1, wherein the bearing portion of the sear defines a through-opening for the trigger spring guide, and the trigger spring guide is arranged inside the trigger spring.

10. The trigger assembly according to claim 1, wherein the bearing portion of the sear defines a slot-shaped through-opening.

11. The trigger assembly according to claim 10, wherein the slot-shaped through-opening is closed at a bottom when viewed in the installation situation.

12. The trigger assembly according to claim 1, wherein the trigger spring guide defines a fork-shaped recess at an end of the trigger spring guide facing the bearing protrusion.

13. The trigger assembly according to claim 1, wherein the trigger spring guide includes a T-shape at an end of the trigger spring guide facing the bearing portion of the sear.

14. The trigger assembly according to claim 1, wherein the rear end section of the pawl mount includes a stop configured to limit a tilting movement of the sear about the sear axis.

15. The trigger assembly according to claim 1, wherein the sear includes lateral bearing protrusions for mounting the sear in the rear end section of the pawl mount.

16. The trigger assembly according to claim 1, wherein the sear plane of the sear has a convex contour.

17. The trigger assembly according to claim 16, wherein, when in a rest position and viewed in a lateral direction, the sear plane follows a constant distance from the mount axis.

18. The trigger assembly according to claim 1, wherein, when in a rest position and viewed in a lateral direction, the sear plane defines a contour that does not exhibit a constant distance to the mount axis.

19. The trigger assembly according to claim 1, further comprising a sear rest formed on the sear plane at an end of the sear facing the firing pin flag.

20. The trigger assembly according to claim 1, wherein the catch arm of the pawl mount defines an inlet guide.

21. A firearm, comprising a trigger assembly according to claim 1, wherein the firearm includes a striker assembly with a spring-loaded firing pin and a downwardly-protruding firing pin flag configured to cooperate with the trigger assembly.

22. The firearm according to claim 21, wherein the firearm is a pistol.

* * * * *